US011183805B2

(12) United States Patent
Hsieh et al.

(10) Patent No.: US 11,183,805 B2
(45) Date of Patent: Nov. 23, 2021

(54) CABLE-ARRANGEMENT STRUCTURE AND ELECTRICAL APPARATUS THEREWITH

(71) Applicant: Wistron Corporation, New Taipei (TW)

(72) Inventors: Yi-Fan Hsieh, New Taipei (TW); Chen-An Sung, New Taipei (TW); Chih-Chen Chang, New Taipei (TW); Yao-Tsung Chang, New Taipei (TW)

(73) Assignee: Wistron Corporation, New Taipei (TW)

( * ) Notice: Subject to any disclaimer, the term of this patent is extended or adjusted under 35 U.S.C. 154(b) by 137 days.

(21) Appl. No.: 16/808,319

(22) Filed: Mar. 3, 2020

(65) Prior Publication Data

US 2021/0143597 A1 May 13, 2021

(30) Foreign Application Priority Data

Nov. 12, 2019 (TW) ..... 108140925

(51) Int. Cl.
*H01R 35/02* (2006.01)

(52) U.S. Cl.
CPC ..... *H01R 35/025* (2013.01); *H01R 2201/20* (2013.01)

(58) Field of Classification Search
CPC ..... B01L 2200/147; B01L 2300/1827; B01L 2300/1844; B01L 3/5082; B01L 7/00; B01L 9/06; H01R 2201/12; H01R 2201/20; H01R 35/025
See application file for complete search history.

(56) References Cited

U.S. PATENT DOCUMENTS 5,151,042 A * 9/1992 Okada ..... H02G 11/00 439/15
5,226,831 A * 7/1993 Horiuchi ..... H01R 35/025 439/15
5,637,005 A * 6/1997 Bannai ..... B60R 16/027 439/15
5,657,940 A * 8/1997 Ishikawa ..... H01R 35/025 242/388
5,762,508 A * 6/1998 Tanaka ..... B60R 16/027 439/15

(Continued)

FOREIGN PATENT DOCUMENTS

TW 201440311 A 10/2014

*Primary Examiner* — Abdullah A Riyami
*Assistant Examiner* — Nader J Alhawamdeh
(74) *Attorney, Agent, or Firm* — Winston Hsu

(57) ABSTRACT

A cable-arrangement structure includes two device bodies and a cable. The two device bodies are rotatably connected relative to a rotation axis. The cable has two fixed segments and a connecting segment connecting the two fixed segments. The two fixed segments are fixedly disposed on the two device bodies respectively. The connecting segment is movably disposed surrounding the rotation axis. An electrical apparatus includes the above cable-arrangement; therein, the cable electrically connects the two device bodies. When the two device bodies rotate relatively, by the movability characteristic of the connecting segment, the cable can be free of being tensed or twisted and will not hook other components, and the electrical connection of the two device bodies can be maintained.

16 Claims, 12 Drawing Sheets

(56) References Cited

U.S. PATENT DOCUMENTS

| | | | | |
|---|---|---|---|---|
| 5,951,322 | A * | 9/1999 | Nishikigi | H02G 11/00 439/456 |
| 6,860,745 | B1 * | 3/2005 | Bolen | H01R 35/025 439/164 |
| 9,011,162 | B2 * | 4/2015 | Sato | B60R 16/027 439/15 |
| 2013/0344706 | A1 * | 12/2013 | Sato | B60R 16/037 439/15 |
| 2021/0143597 | A1 * | 5/2021 | Hsieh | H01R 35/025 |

* cited by examiner

CABLE-ARRANGEMENT STRUCTURE AND ELECTRICAL APPARATUS THEREWITH

BACKGROUND OF THE INVENTION

1. Field of the Invention

The present disclosure relates to a cable-arrangement structure, and more particularly to an electrical apparatus with rotary components and a cable-arrangement structure thereof.

2. Description of the Prior Art

Some electrical apparatuses on the market have rotary components for specific requirements. For example, a rotary table of a genetic testing device carries tubes and rotates so that a fluorescent reagent can be detected for each tube. The rotary table needs to be heated for keeping the tubes at a specific degree for reaction of the fluorescent reagent, so the rotary table needs to rotate and be heated at the same time so as to complete the fluorescence detection. The cable connected to the heater and sensor in the rotary table is also connected to the control circuit board of the genetic testing device. If the cable is not arranged in particular, the cable probably hooks other components, even to break, when the rotary table rotates. There are products available on the market, of which the cable is arranged along the rotation axis of the rotary table. When the rotary table rotates, the cable will twist. Furthermore, the cable occupies the space along the rotation axis, so the space cannot accommodate other components in principle. The rotation mechanism of the rotary table has to be shifted, which results to a larger product space.

SUMMARY OF THE INVENTION

An objective of the disclosure is to provide a cable-arrangement structure, of which a cable is arranged around and utilizes a movable segment of the cable to prevent the cable from being stretched or twisted, so as to ensure the function of the cable.

A cable-arrangement structure according to the disclosure includes a first device body, a second device body rotatably connected with the first device body relative a rotation axis, and a cable. The cable has a first fixed segment fixed to the first device body, a second fixed segment fixed to the second device body, and a connecting segment connecting the first fixed segment and the second fixed segment and being movably around the rotation axis.

Another objective of the disclosure is to provide an electrical apparatus, which includes the above cable-arrangement structure and utilizes the movable segment of the cable to prevent the cable from being stretched or twisted, so as to ensure the function of the cable.

An electrical apparatus according to the disclosure includes a first device body with a first electrical connection portion, a second device body with a second electrical connection portion, and a cable. The first and second device bodies are rotatably connected with each other relative to a rotation axis. The cable has a first fixed segment fixed to the first device body and electrically connected to the first electrical connection portion, a second fixed segment fixed to the second device body and electrically connected to the second electrical connection portion, and a connecting segment connecting the first fixed segment and the second fixed segment and being movably around the rotation axis.

Compared with the prior art, in the cable-arrangement structure and the electrical apparatus having the cable-arrangement structure according to the disclosure, even when the first and second device bodies rotate relatively, by the movability characteristic of the connecting segment of the cable, the cable can be free of being tensed or twisted and will not hook other components, so that the mechanical connection of the cable with the two device bodies and the electrical connection of the two device bodies through the cable can be maintained. Furthermore, the cable is arranged around the rotation axis, so other components can be disposed between the two device bodies along the rotation axis, e.g. a rotation connection structure therefor. Such structural configuration can avoid excessively increasing the volume of the electrical apparatus.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
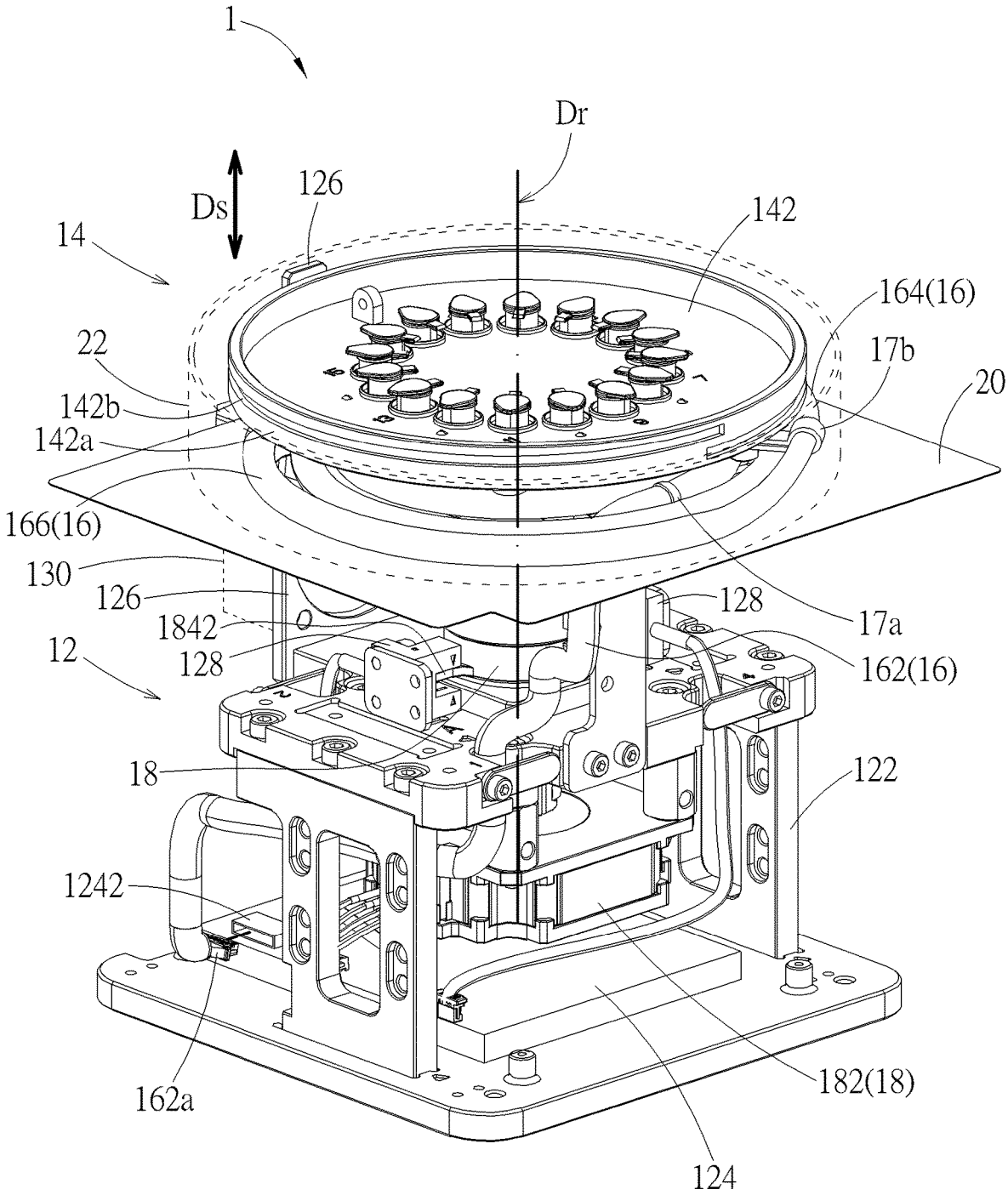
FIG. 1 is a schematic diagram illustrating an electrical apparatus according to an embodiment.
Figure 2:
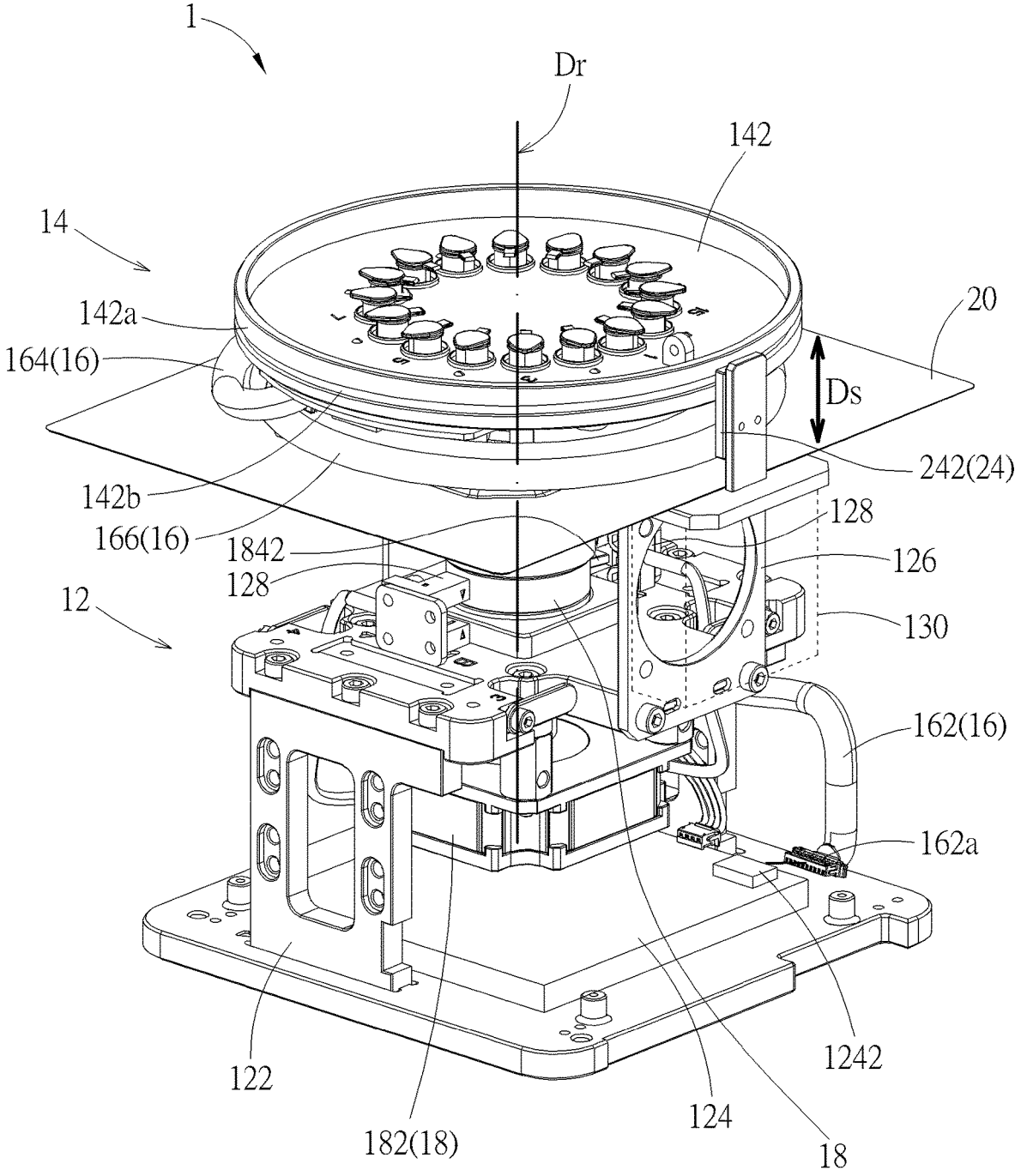
FIG. 2 is a schematic diagram illustrating the electrical apparatus in FIG. 1 in another view point.
Figure 3:
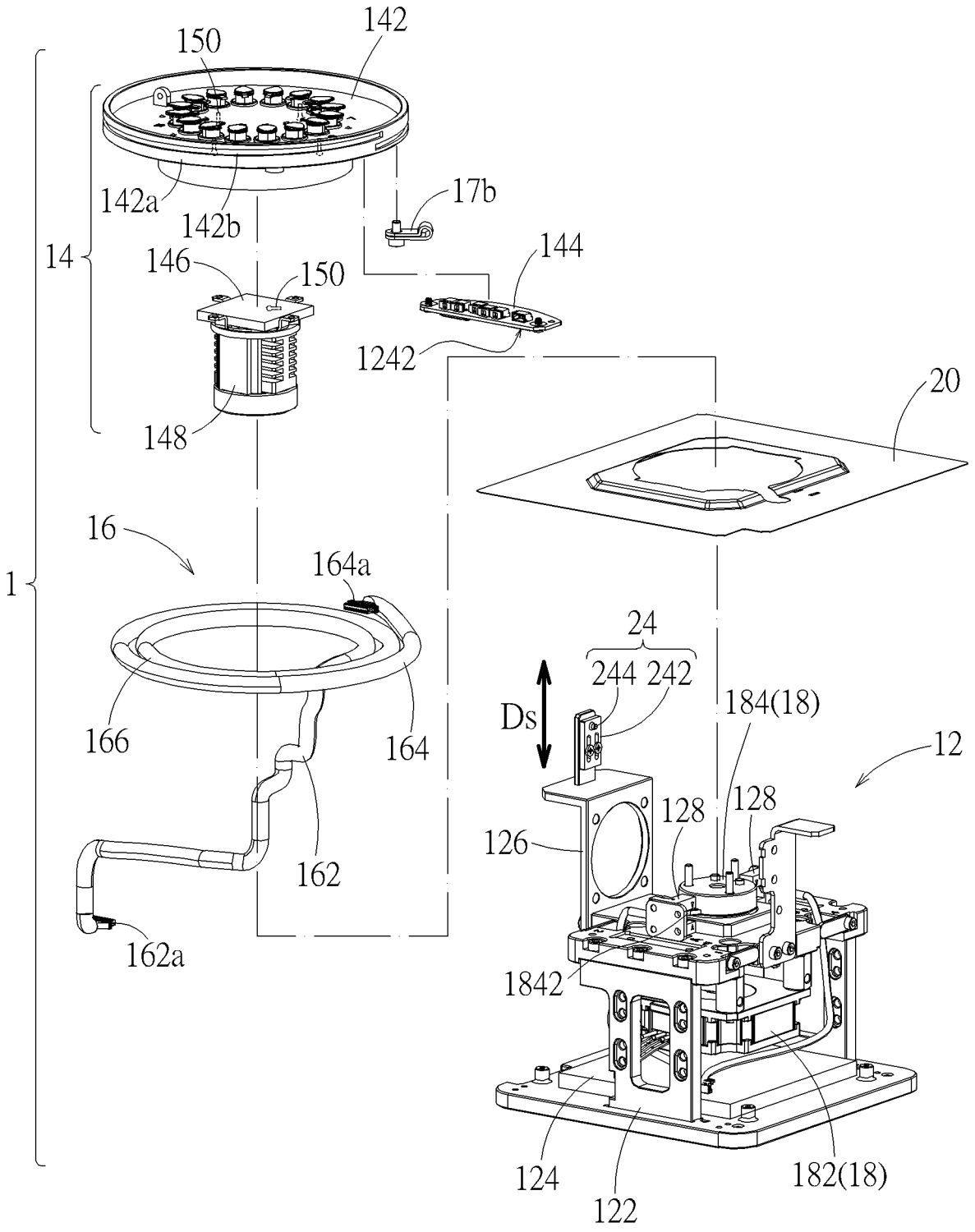
FIG. 3 is a partially exploded view of the electrical apparatus in FIG. 1.
Figure 4:
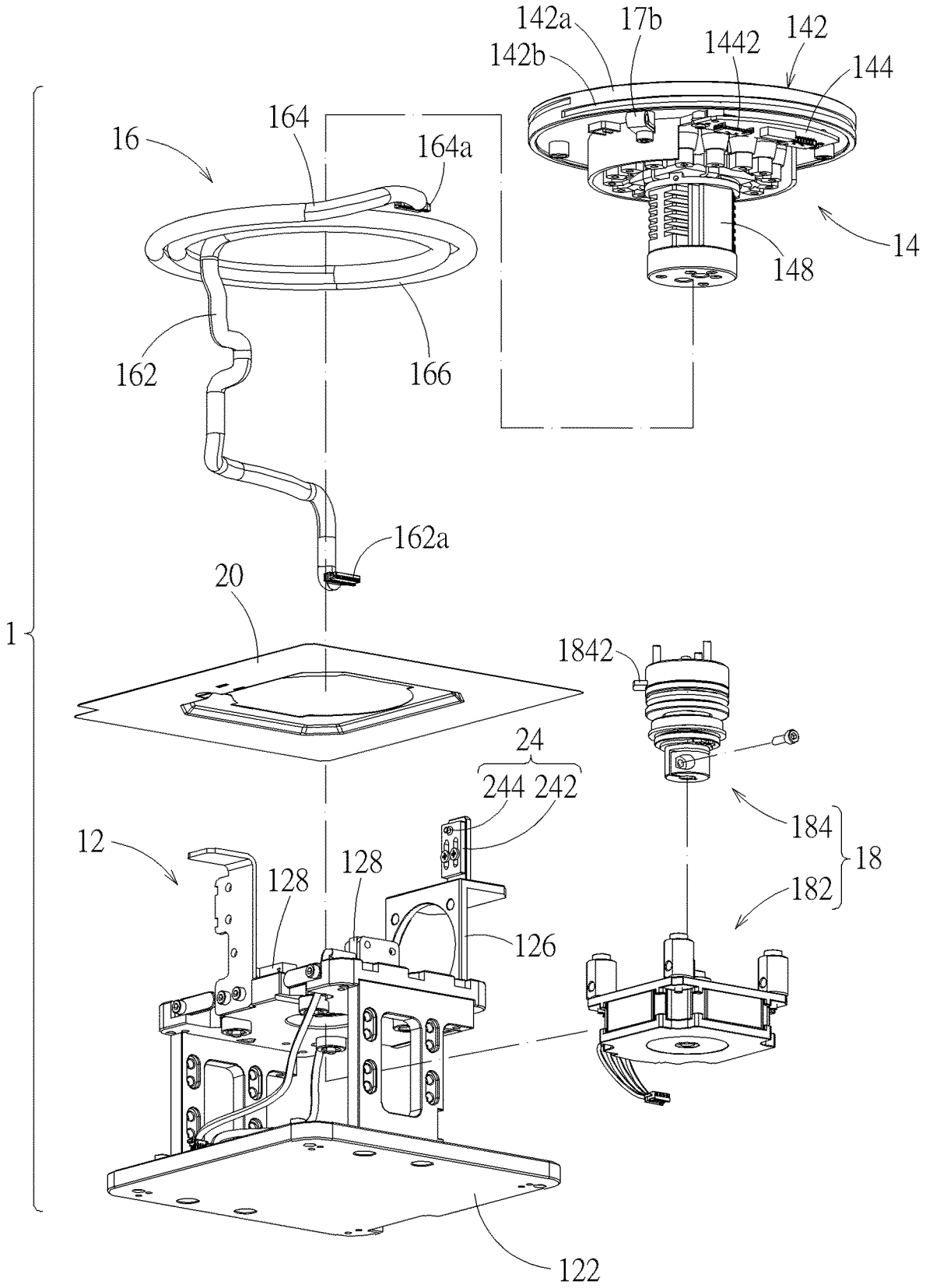
FIG. 4 is another partially exploded view of the electrical apparatus in FIG. 1.

Please refer to FIG. 1 to FIG. 5. An electrical apparatus 1 according to an embodiment includes a first device body 12, a second device body 14, and a cable 16. In practice, the electrical apparatus 1 can include an outer casing in addition, for housing the first device body 12, the second device body 14, and the cable 16 . The actual details of the outer casing depend on actual product specification and will not be described in addition. The first and second device bodies 12 and 14 are rotatably connected relative to a rotation axis Dr (indicated by a chained line in FIG. 1, FIG. 2 and FIG. 5). The cable 16 has a first fixed segment 162 fixed to the first device body 12, a second fixed segment 164 fixed to the second device body 14, and a connecting segment 166 connecting the first fixed segment 162 and the second fixed segment 164 and being movably around the rotation axis Dr. The first device body 12, the second device body 14, and the cable 16 are configured to form a specific cable-arrangement structure, in which the cable 16 utilizes the movable connecting segment 166 to provide a buffer for allowing the first and second fixed segments 162 and 164 to move relatively, so that when the first and second device bodies 12 and 14 rotate relatively, the cable 16 can avoid being stretched or twisted and will not hook other components, so as to maintain the mechanical connection between the first and second device bodies 12 and 14. Similarly, when the first and second fixed segments 162 are electrically connected to a respective electrical control portion of the first and second device bodies 12 and 14, the cable 16 can maintain the electrical connection between the first and second device body 12 and 14.

In the embodiment, the first device body 12 is a base that includes a base 122 and a first controlling module 124 (indicated by a rectangular block). The base 122 is fixed to the bottom of the outer casing. The first controlling module 124 is disposed on the base 122 and includes a first electrical connection portion 1242 (e.g. but not limited thereto a jack connector). The second device body 14 is a rotary assembly that includes a rotary table 142 and a second controlling module 144. The second controlling module 144 is fixed to the rotary table 142 and includes a second electrical connection portion 1442 (e.g. but not limited to a jack connector). In practice, the first and 144 controlling modules 124 respectively can be realized by but not limited to a circuit board module (e.g. including a circuit board and required electronic components disposed thereon). The electrical apparatus 1 also further includes a rotation connection structure 18 that is disposed along the rotation axis Dr and incudes a motor 182 and a transmission structure 184. The motor 182 is fixed to the base 122. The transmission structure 184 connects a rotary shaft of the motor 182 and the second device body 14, so that the first and second device bodies 12 and 14 are rotatably connected through the rotation connection structure 18. The motor 182 drives the second device body 14 to rotate through the transmission structure 184. The first controlling module 124 is electrically connected to the motor 182 to control the operation of the motor 182.

Furthermore, in the embodiment, the second device body 14 further includes a heating part 146 and a heat-dissipating structure 148 that are fixed to the rotary table 142 and arranged along the rotation axis Dr. The heat-dissipating structure 148 is thermally coupled with the heating part 146 (e.g. by directly contacting, filling with thermally conductive material therebetween). The heat-dissipating structure 148 is also connected with the transmission structure 184, so that the rotation connection structure 18 drives the rotary table 142 to rotate relative the rotation axis Dr through the transmission structure 184 and the heat-dissipating structure 148. The second controlling module 144 is electrically connected to the heating part 146 to control the heating part 146 to heat the rotary table 142. The heating part 146 and the rotary table 142 rotate together, so the heating part 146 can heat the rotary table 142 directly, of which the heating efficiency is good. In practice, the heating part 146 can directly contact the rotary table 142; it is practicable to fill with thermally conductive material therebetween. Furthermore, in the embodiment, the second device body 14 includes a plurality of electronic components (e.g. in addition to the heating part 146, also including but not limited to thermistors 150, of which the profiles are shown in dashed lines in FIG. 3) electrically connected to the second controlling module 144 (therein, the connection cables therefor are not shown in the figures for simplification of drawing). The second controlling module 144 can control the operation of the heating part 146 according to sensing signals of the thermistors 150.

Furthermore, in the embodiment, the connecting segment 166 of the cable 16 is wound around the rotation connection structure 18. The cable 16 has plug connectors 162*a* and 164*a* disposed at an end of the first fixed segment 162 and at an end of the second fixed segment 164 respectively. The first and second fixed segments 162 and 164 are electrically connected to the first controlling module 124 (of the first device body 12) and the second controlling module 144 (of the second device body 14) by inserting the plug connectors 162*a* and 164*a* to the first and second electrical connection portions 1242 and 1442 respectively. Thereby, the first controlling module 124 can provide power to and communicate with the second controlling module 144 through the cable 16. Furthermore, the first and second fixed segments 162 and 146 are fixed to the base 122 (of the first device body 12) and the rotary table 142 (of the second device body 14) through at least one fixing part 17*a* and at least one fixing part 17*b* (e.g. but not limited to a cable tie or a cable clip) respectively.

Figure 5:
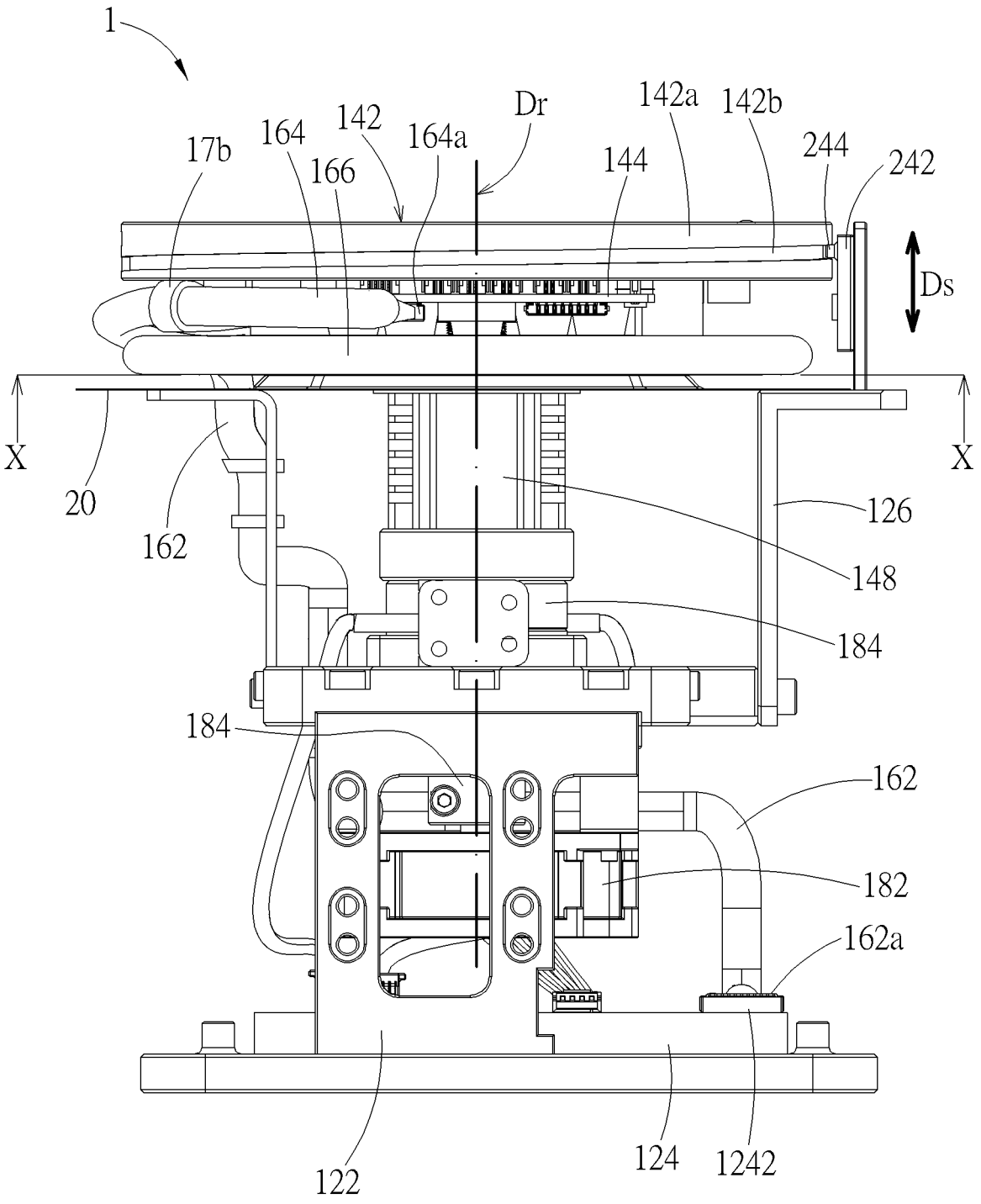
FIG. 5 is a side view of the electrical apparatus in FIG. 1.
Figure 6:
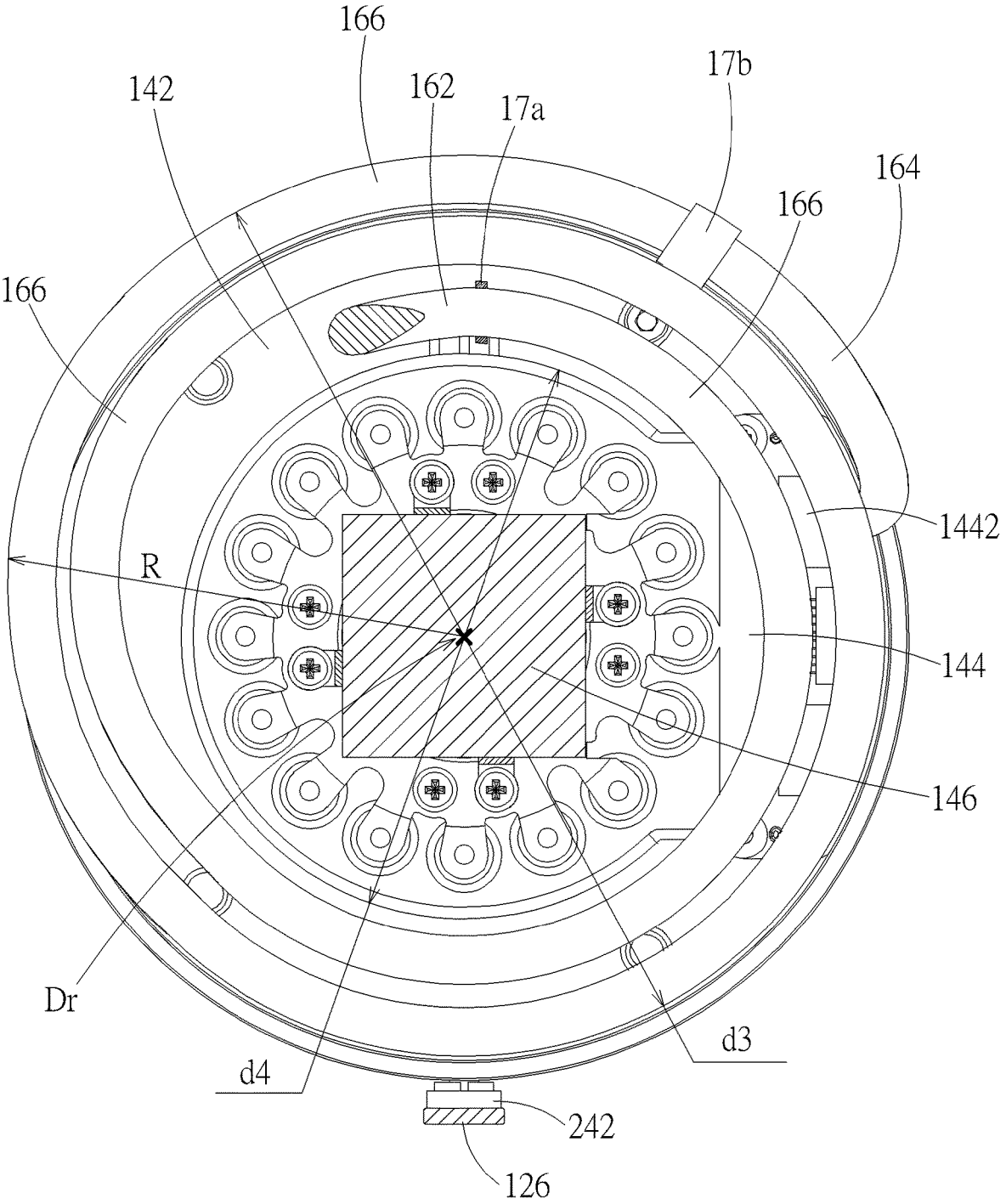
FIG. 6 is a sectional view of the electrical apparatus along the line X-X in FIG. 1.
Figure 7:
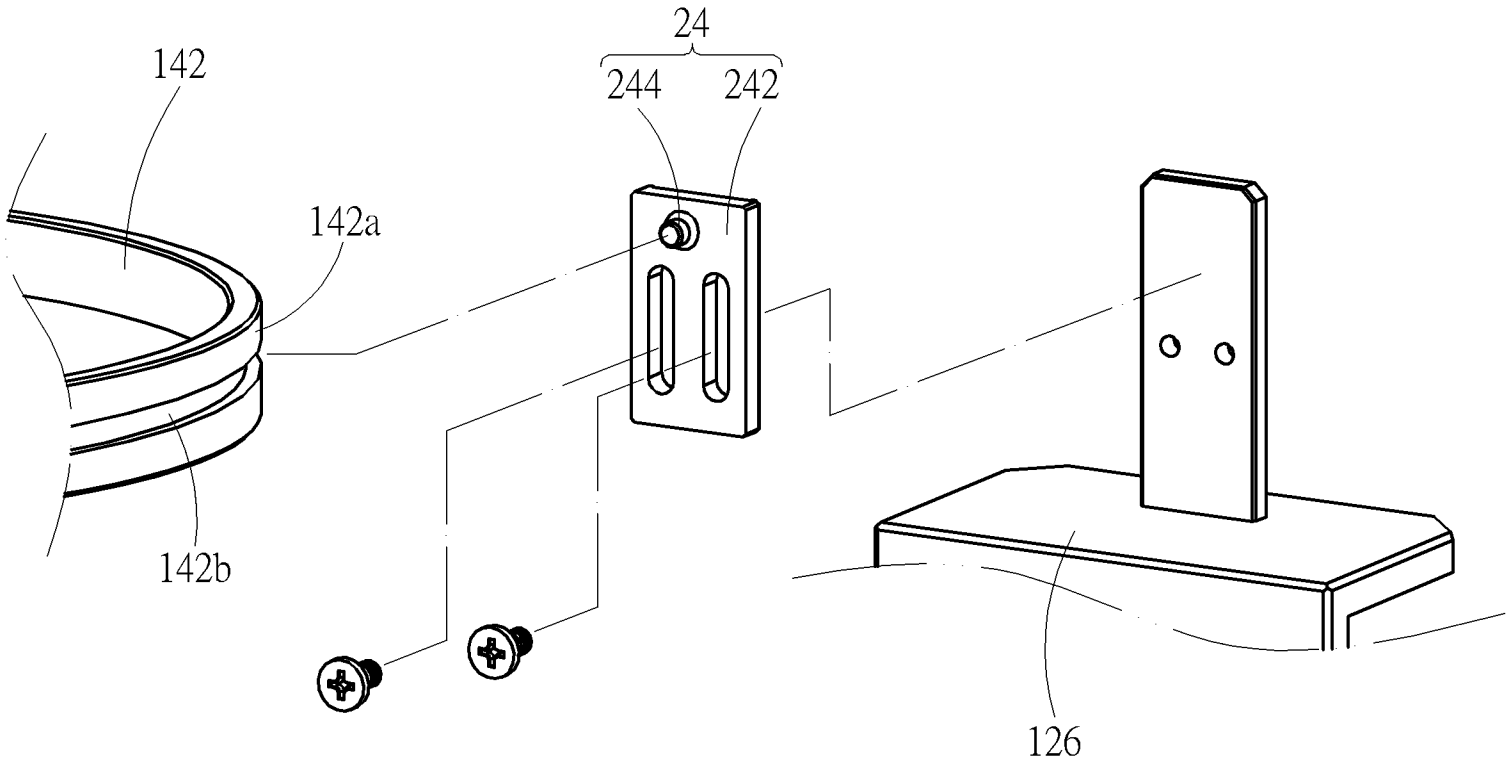
FIG. 7 is an exploded view of a portion of a rotary table and a guiding part of the electrical apparatus in FIG. 1.

Please refer to FIG. 5 and FIG. 6. In principle, the portion of the cable 16 between the fixing part 17*a* and the plug connector 162*a* can be regarded as the first fixed segment 162 that will not move along with other components (e.g. the second device body 14 when driven to rotate) . The portion of the cable 16 between the fixing part 17*b* and the plug connector 164*a* can be regarded as the second fixed segment 164 that will move along with the rotary table 142 (e.g. when the rotary table 142 is driven to rotate) . The portion of the cable 16 between the fixing part 17*a* and the fixing part 17*b* can be regarded as the connecting segment 166. As shown by FIG. 6, the connecting segment 166 is loose, so that the rotary table 142 can rotate relative to the first device body 12 within a certain angle range, without stretching or twisting the cable 16; thereby, the mechanical and electrical connection between the first device body 12 and the second device body 14 through the cable 16 can be maintained. Therefore, the connecting segment 166 has a buffer effect.

The above angle range can be determined according to the length of the connecting segment 166, which can be accomplished by a simple experiment. Furthermore, the angle range is not limited to within 360 degrees. In practice, a rotatable angle range of the second device body 14 relative to the first device body 12 is positively correlated with a length of the connecting segment 166. That is, the longer the connecting segment 166 is, the larger the rotatable angle range is; the shorter the connecting segment 166 is, the smaller the rotatable angle range is. In the embodiment, the connecting segment 166 is wound around the rotation axis Dr by at least one turn (e.g. about more than two turns, as shown by FIG. 6). The rotary table 142 can rotate easily within an angle range of +/−180 degrees or more (relative to the state as shown by FIG. 6) without stretching, twisting or excessively compressing the cable 16. For example, in the view point of FIG. 6, the rotary table 142 can rotate to drive the second fixed segment 164 to rotate 180 degrees counterclockwise; at the moment, the connecting segment 166 is relatively loose. In practice, without considering other structural restrictions (e.g. structures that obstruct the rotation of the rotary table 142, structures that restrict the loose degree of the connecting segment 166, and so on), the rotary table 142 can drive the second fixed segment 164 to rotate more than 180 degrees counterclockwise. Furthermore, the rotary table 142 can rotate to drive the second fixed segment 164 to rotate 180 degrees clockwise. Similarly, without considering other structural restrictions (e.g. structures that obstruct the rotation of the rotary table 142, insufficient gaps for winding the cable 16, and so on), the rotary table 142 can drive the second fixed segment 164 to rotate more than 180 degrees clockwise. At the moment, the connecting segment 166 is relatively tense, but not stretched, twisted or excessively compressed. Therefore, the cable 16 will not substantially suffer tensile stress, compressive stress, or shear stress within the rotatable angle range. After long-term operation of the electrical apparatus 1, the cable 16 will not produce fatigue failure due to the rotation of the rotary table 142 in principle. In addition, in the embodiment, because the connecting segment 166 is disposed along a loop relative to the rotation axis Dr, the connecting segment 166 will not structurally interfere with structures inside the loop (e.g. the rotation connection structure 18) in principle. On the other hand, the connecting segment 166 can directly utilize the space between the first and second device body 12 and 14 and the space outside the rotation connection structure 18. In principle, it is unnecessary to plan space especially for the connecting segment 166. Such structural configuration is conducive to avoidance of excessively increasing the volume of the electrical apparatus 1.

Furthermore, in the embodiment, the electrical apparatus 1 also includes a supporting plate 20 that is disposed between the first and second device bodies 12 and 14 and fixed to the base 122. The connecting segment 166 is located between the second device body 14 and the supporting plate 20. The first fixed segment 162 is located between the first device body 12 and the supporting plate 20. Furthermore, in addition to supporting the cable 16 (or the connecting segment 166 thereof), the supporting plate 20 is also conducive to the connecting segment 166 smoothly moving when the second device body 14 rotates relative to the first device body 12. Furthermore, in the embodiment, a reference plane (i.e. a plane parallel to the supporting plate 20) is defined and is perpendicular to the rotation axis Dr. A projection of the connecting segment 166 onto the reference plane shows a spiral (as shown by FIG. 6) . Furthermore, in the embodiment, a projection of the connecting segment 166 onto the reference plane does not overlap, which is conducive to the connecting segment 166 smoothly moving when the second device body 14 rotates relative to the first device body 12, and which is also conducive to reducing the distance between the supporting plate 20 and the rotary table 142.

Furthermore, in the embodiment, even during the rotation of the second device body 14 relative to the first device body 12, the connecting segment 166 remains looped. The connecting segment 166 will not hook other structures in principle. In practice, the electrical apparatus 1 can include a limitation structure 22 (shown in dashed lines in FIG. 1) for structurally restricting the movement of the connecting segment 166 further. In this instance, the limitation structure 22 is disposed in a loop substantially and surrounds the connecting segment 166 relative to the rotation axis Dr between the first and second device bodies 12 and 14. The limitation structure 22 is fixed to the supporting plate 20, the base 122, or the rotary table 142. The limitation structure 22 can restrict the connecting segment 166 from moving outward (e.g. the second device body 14 rotating relative to the first device body 12 to loosen the connecting segment 166) . Furthermore, in the instance, the limitation structure 22 is a continuous structure; however, in practice, the limitation structure 22 can be realized by a plurality of parts separate disposed (e.g. several posts that substantially evenly disposed on the periphery of the outside of the connecting segment 166), which also can perform the effect like the above structural restriction.

Please refer to FIG. 1, FIG. 2, and FIG. 5 to FIG. 8. As described above, the rotatable angle range of the second device body 14 relative to the first device body 12 is larger than 360 degrees. In the embodiment, the electrical apparatus 1 also includes a guiding part 24 slidably connected to the base 122 (of the first device body 12) along a sliding direction Ds (indicated by a double-head arrow in FIG. 1 and FIG. 5, parallel to the rotation axis Dr). Therein, the guiding part 24 includes a sliding portion 242 and a protruding post 244 fixed on the sliding portion 242. The sliding portion 242 is slidably connected to a fan bracket 126 fixed on the base 122. The rotary table 142 of the second device body 14 has a peripheral wall surface 142*a* and a guiding slot 142*b* formed on the peripheral wall surface 142*a*. The guiding slot 142*b* extends around the rotation axis Dr and has two end portions 142*c* and 142*d*. The protruding post 244 extends into the guiding slot 142*b* perpendicular to the rotation axis Dr. When the rotary table 142 rotates, the protruding post 244 slides in the guiding slot 142*b*, and the sliding portion 242 moves up and down relative to the fan bracket 126.

In practice, within the rotatable angle range of the second device body 14 relative to the first device body 12, the rotation angle of the rotary table 142 can be limited by the protruding post 244 blocking the end portions 142*c* and 142*d* for avoidance of damage on the cable 16, which is also conducive to the cable 16 smoothly moving as the rotary table 142 rotates. In the embodiment, the guiding slot 142*b* shows a spiral relative to the rotation axis Dr, so that the extension angle of the guiding slot 142*b* (i.e. a central angle relative to the rotation axis Dr) can be designed easily to be over 360 degrees. In the embodiment, the peripheral wall surface 142*a* has a circumference (i.e. equal to the radius R of the peripheral wall surface 142*a* multiplied by 2 times of the mathematical constant n) relative to the rotation axis Dr. The extension length of the guiding slot 142*b* (or the projection extension length of the guiding slot 142*b* onto the reference plane) is substantially larger than or equal to a sum of the circumference and a width W of the protruding post 244 (indicated by a dashed circle in FIG. 8) . On the other hand, the guiding slot 142*b* extends relative to the rotation axis Dr by at least one turn. Furthermore, in the embodiment, the distance d1 corresponding to the overlapped portions of the guiding slot 142*b* parallel to the rotation axis Dr is 4 mm; the width d2 of the peripheral wall surface 142*a* parallel to the rotation axis Dr is 9 mm. In practice, the distance d1, the width d2, and the width of the guiding slot 142*b* depend on actual products and will not be described in addition. Therefore, the rotatable angle range of the rotary table 142 is larger than or equal to 360 degrees. The guiding slot 142*b* restricts the rotary table 142 to rotate within the rotatable angle range. For example, the rotatable angle range of the rotary table 142 is slightly larger than 360 degrees. The guiding slot 142*b* restricts the rotary table 142 to rotate within 360 degrees. Therein, the transmission structure 184 has a tab 1842 protruding outward perpendicular to the rotation axis Dr, in coordination with two sensors 128 (disposed on the base 122 and electrically connected to the first controlling module 124; e.g. but not limited to optical sensors that can detect whether the tab 1842 enters the detection area of the sensor 128). The first controlling module 124 controls the motor 182 to rotate according to the sensing signals by the sensors 128, so as to achieve the +/−180 degree rotation. For example, as the state of the electrical apparatus 1 shown in FIG. 1, FIG. 2, FIG. 5 and FIG. 6, the rotary table 142 can be defined as being at an orientation of 0 degree. The protruding post 244 is located at the middle position of the guiding slot 142*b*. The tab 1842 enters the detection area of one sensor 128. In the top view of the electrical apparatus 1, when the rotary table 142 clockwise rotates 180 degrees from the orientation of 0 degree, the rotary table 142 can be defined as being at an orientation of +180 degrees. The protruding post 244 is close to or abuts against the end portion 142*c* by design; the tab 1842 rotates 180 degrees clockwise to enter the detection area of the other sensor 128. When the rotary table 142 counterclockwise rotates 180 degrees from the orientation of 0 degree, the rotary table 142 can be defined as being at an orientation of −180 degrees. The protruding post 244 is close to or abuts against the end portion 142*d* by design; the tab 1842 rotates 180 degrees counterclockwise to enter the detection area of the other sensor 128.

Furthermore, the rotatable angle range of the rotary table 142 is positively correlated with the length of the connecting segment 166. The required radius area for the rotation of the connecting segment 166 within the rotatable angle range is related to the outside diameter of the wound connecting segment 166. The winding of the connecting segment 166 can be designed conceptually through simple geometric relations. As shown by FIG. 6, the connecting segment 166 has a winding outside diameter d3. The rotary table 142 has a winding inner diameter d4. The length of the connecting segment 166 complies with the following equation:

$$L=N\times d4\times\pi;$$

therein, the L is the length of the connecting segment 166, and the N is the number of the winding of the connecting segment 166.

When the rotary table 142 rotates 360 degrees (i.e. by one turn) to make the connecting segment 166 looser, the number of the winding of the connecting segment 166 will decrease by one. At the moment, the winding outside diameter d3 of the connecting segment 166 complies with the following equation:

$$d3=(N\times d4\times\pi)/[(N-1)\times\pi];$$

that is, $$d3=\frac{N}{N-1}d4.$$

If the rotary table 142 rotates by m turns, the current winding outside diameter d3 of the connecting segment 166 complies with the following equation:

$$d3=(N\times d4\times\pi)/[(N-m)\times\pi];$$

that is, $$d3=\frac{N}{N-m}d4.$$

Figure 8:
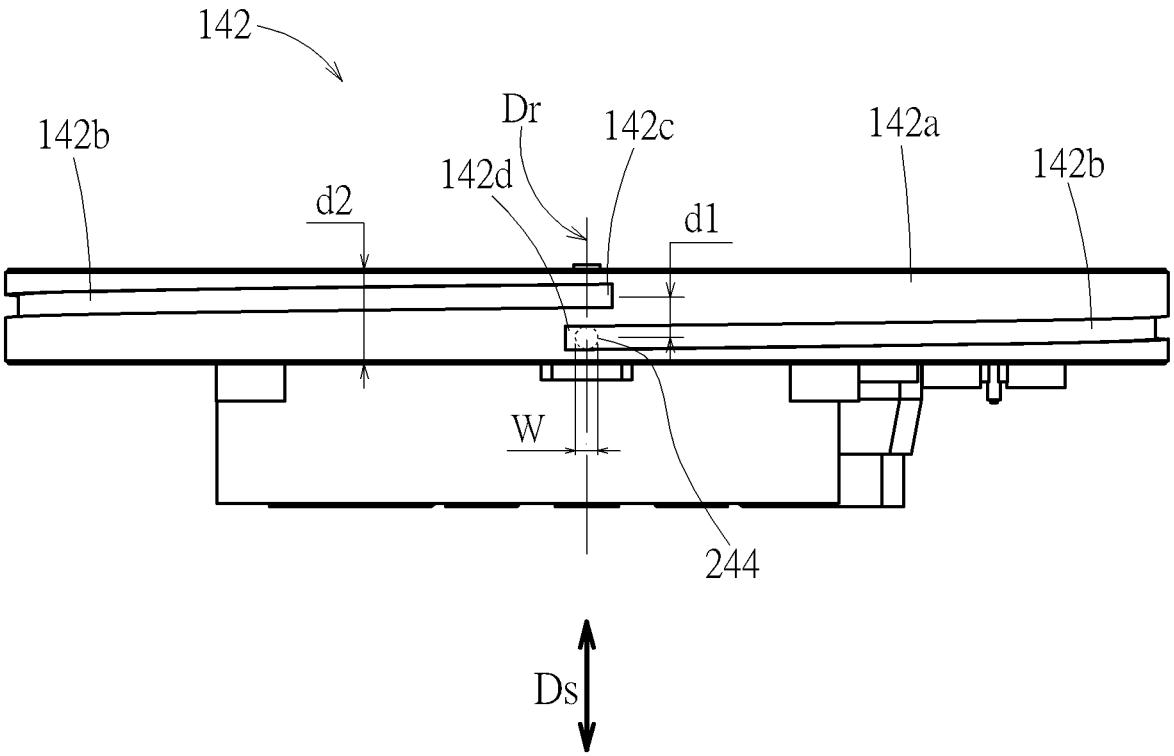
FIG. 8 is a side view of the rotary table in FIG. 7 in another view point.

Furthermore, as shown by FIG. 5 and FIG. 8, in the embodiment, peripheral wall surface 142*a* is located at the outermost periphery of the rotary table 142; however, it is not limited thereto in practice. For example, the rotary table 142 has a side wall protruding downward. The side wall also can be taken as the peripheral wall surface 142*a* and forms the guiding slot 142*b* thereon. Furthermore, if the rotary table 142 is controlled to rotate within 360 degrees by design, it is unnecessary for the guiding slot 142*b* to extend in a spiral in principle. The guiding slot 142*b* can extend on the same plane (perpendicular to the rotation axis Dr). In addition, a fan 130 (indicated by a dashed rectangular block in FIG. 1 and FIG. 2) can be installed onto the fan bracket 126. The fan 130 dissipates heat of the heat-dissipating structure 148 (e.g. but not limited to including a plurality of fins). Furthermore, the heat-dissipating structure 148 rotating along with the rotary table 142 is also conducive to heat dissipation.

In the cable-arrangement structure of the electrical apparatus 1, the cable 16 is spirally wound between the first and second device bodies 12 and 14; however, it is not limited thereto in practice. Please refer to FIG. 9 and FIG. 10. An electrical apparatus 3 according to another embodiment is similar to the electrical apparatus 1 in structural logic, so the electrical apparatus 3 uses the reference numbers of the electrical apparatus 1 for simplification of description. For other descriptions about the components of the electrical apparatus 3, please refer to the relevant descriptions of the components of the electrical apparatus 1 and variants thereof in the foregoing, which will not be described in addition. A main difference between the electrical apparatus 3 and the electrical apparatus 1 is in the cable-arrangement structure. In the electrical apparatus 3, the cable 36 has a first fixed segment 362, a second fixed segment 364, and a connecting segment 366 connecting the first and second fixed segments 362 and 364. The first and second fixed segments 362 and 364 are fixed to the base 122 (of the first device body 12) and the rotary table 142 (of the second device body 14) through at least one fixing part 17*a* and at least one fixing part 17*b* (e.g. but not limited to a cable tie or a cable clip) respectively; the connecting segment 366 is wound around the rotation axis Dr and movably disposed between the first and second device bodies 12 and 14.

Figure 11:
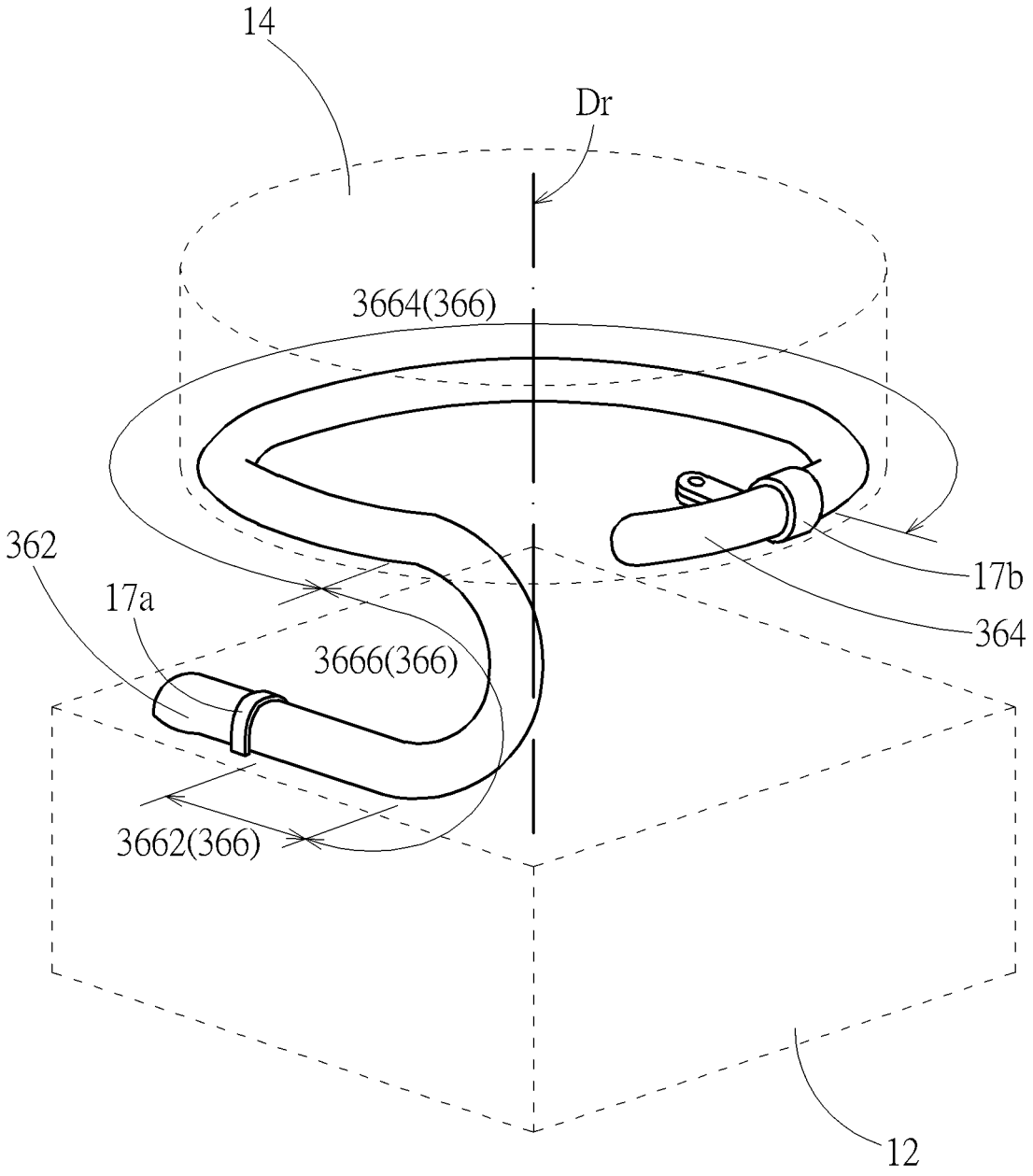
FIG. 11 is a schematic diagram illustrating a configuration of a cable of the electrical apparatus in FIG. 9.
Figure 12:
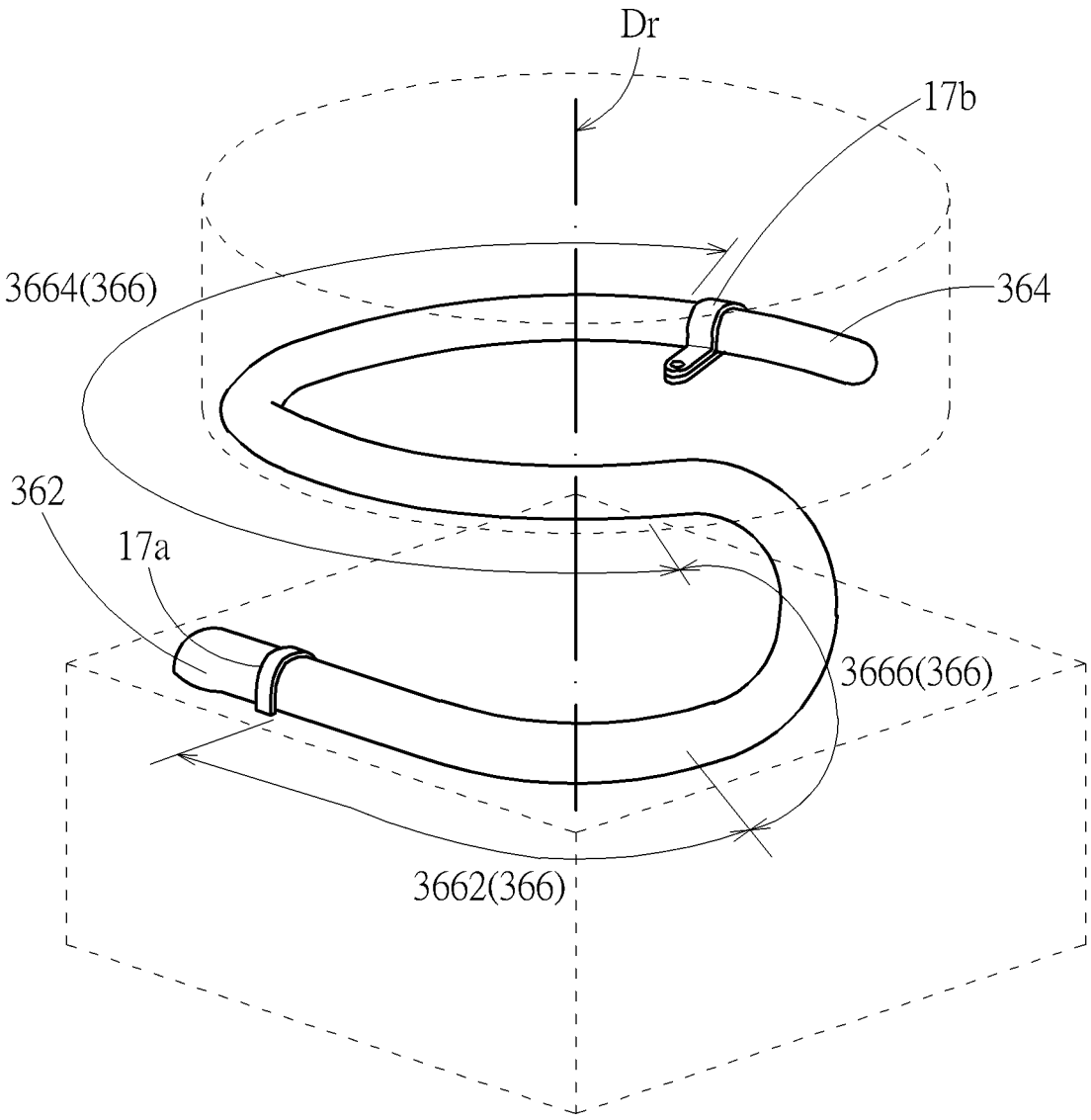
FIG. 12 is a schematic diagram illustrating the configuration of the cable after a first device body and a second device body of the electrical apparatus in FIG. 11 rotate relatively by an angle.

Please also refer to FIG. 11; therein, the first and second device bodies 12 and 14 respectively are indicated by a single block in dashed lines in the figure. In the embodiment, the connecting segment 366 includes a first abutting segment 3662 abutting against the first device body 12 (or the base 122 thereof), a second abutting segment 3664 abutting against the second device body 14 (or the rotary table 142 thereof), and an intermediate segment 3666 connecting the first abutting segment 3662 and the second abutting segment 3664. In FIG. 11, the extents of the first and second abutting segments 3662 and the connecting segment 366 are indicated by dimensioning. In the embodiment, the lengths of the first abutting segment 3662 and the second abutting segment 3664 vary as the first device body 12 and the second device body 14 relatively rotate; the length of the intermediate segment 3666 is unchanged in principle. Please also refer to FIG. 12. After the first and second device bodies 12 and 14 relatively rotate by an angle (e.g. from the state as shown by FIG. 11 to the state as shown by FIG. 12), the length of the first abutting segment 3662 decreases, the length of the second abutting segment 3664 increases, and the length of the intermediate segment 3666 remains unchanged substantially. Therein, the sum of the length of the first abutting segment 3662 and the length of the second abutting segment 3664 remains unchanged in principle; the intermediate segment 3666 substantially keeps in a semicircle shape.

Figure 9:
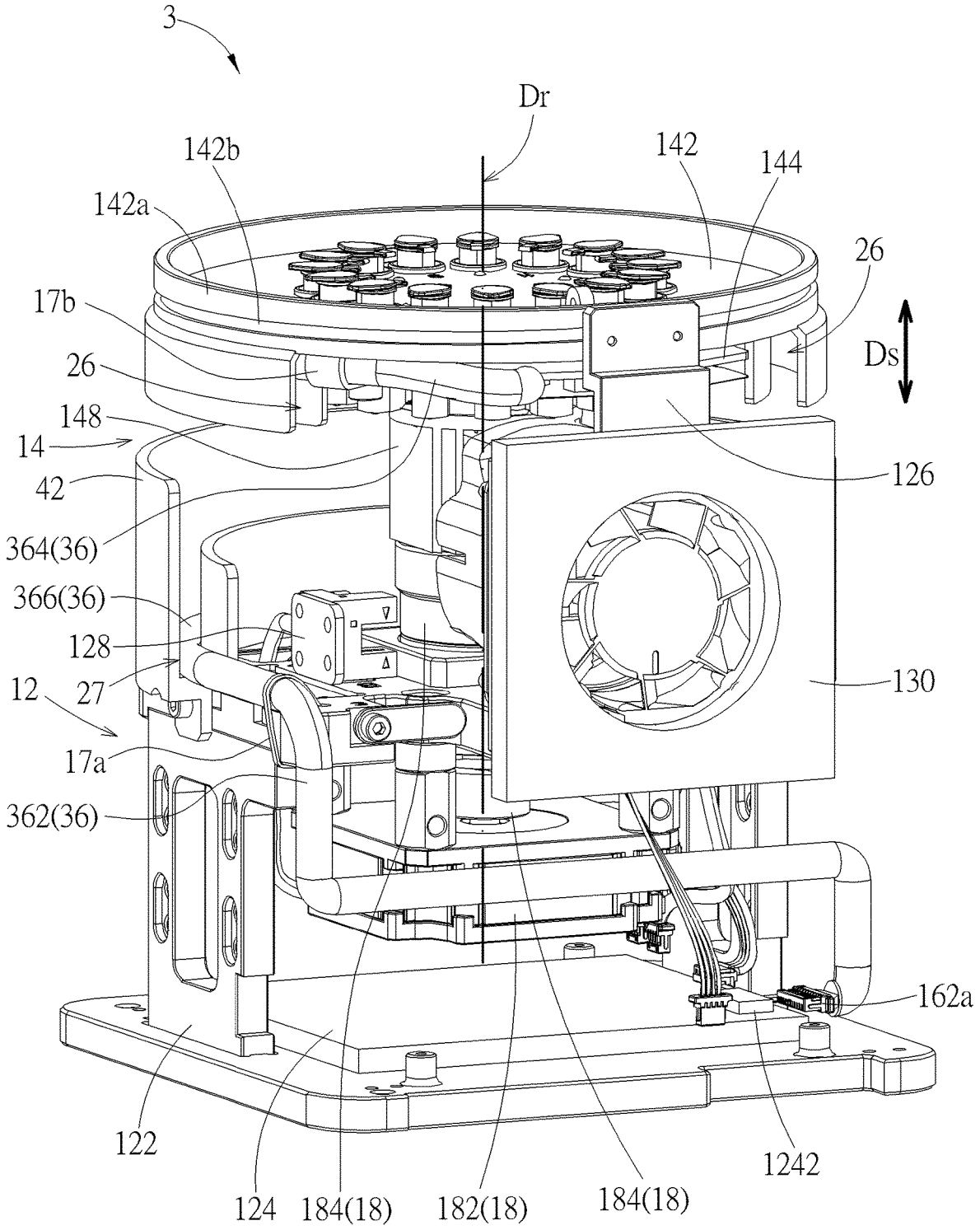
FIG. 9 is a schematic diagram illustrating an electrical apparatus according to another embodiment.
Figure 10:
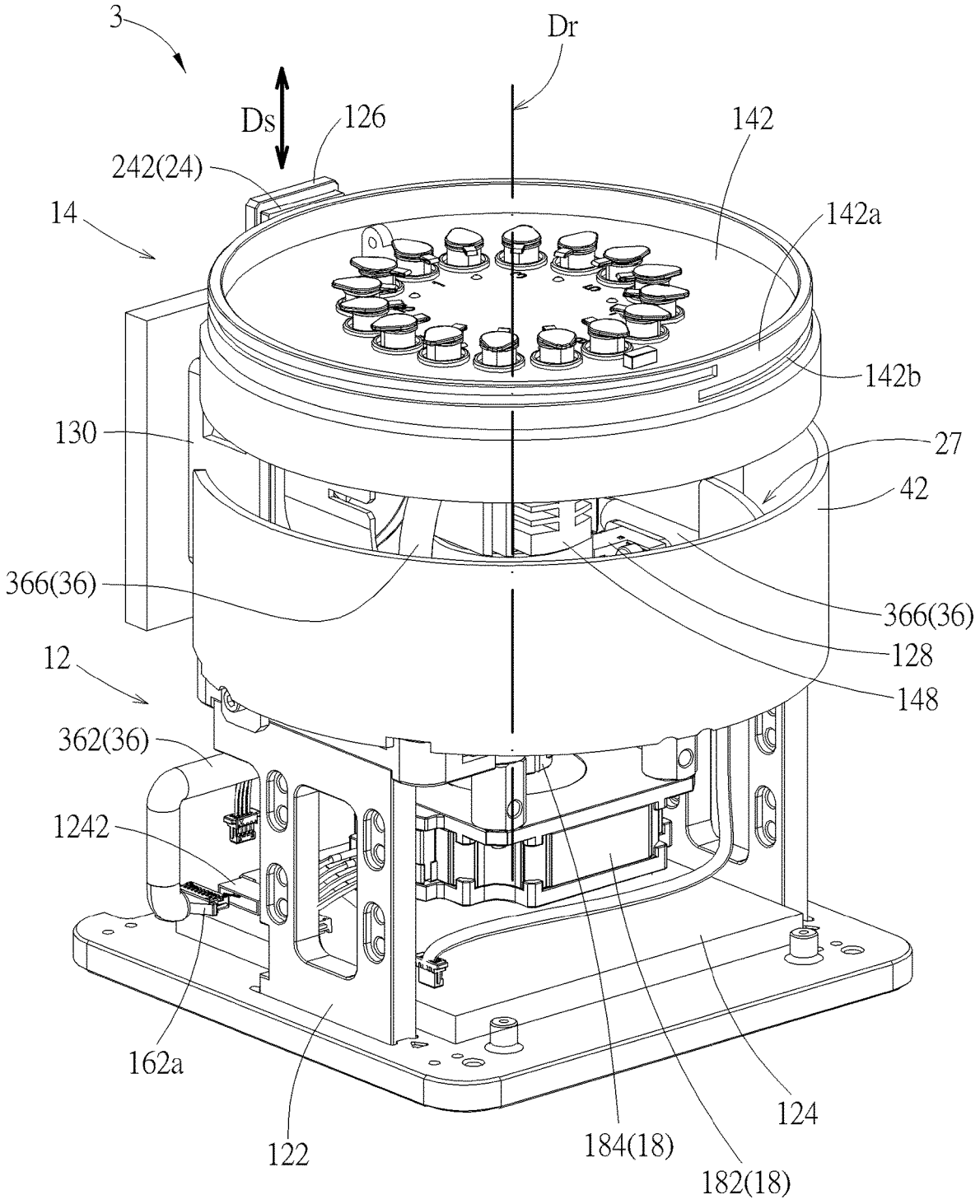
FIG. 10 is a schematic diagram illustrating the electrical apparatus in FIG. 9 in another view point.

Furthermore, in the embodiment, as shown by FIG. 9 and FIG. 10, the electrical apparatus 3 also includes an accommodating slot 26 that is disposed on the second device body 14 (or the rotary table 142 thereof, e.g. by structurally integrating with the rotary table 142 to be a single part) and extends around the rotation axis Dr. The second abutting segment 3664 is accommodated in the accommodating slot 26. The electrical apparatus 3 also includes another accommodating slot 27 that is disposed on the first device body 12 (or the base 122 thereof) and extends around the rotation axis Dr. The first abutting segment 3662 is accommodated in the accommodating slot 27. The accommodating slots 26 and 27 are conducive to the second abutting segment 3664 and the first abutting segment 3662 stably abutting against the rotary table 142 and the base 122 respectively, and also conducive to the connecting segment 366 smoothly abutting against the first device body 12 and the second device body 14 (or the rotary table 142 thereof) during the rotation of the rotary table 142. In addition, in the embodiment, the electrical apparatus 3 also includes a limitation structure 42 that is disposed between the first and second device bodies 12 and 14 and surrounds the connecting segment 366 relative to the rotation axis Dr, so as to structurally restrict the movement of the connecting segment 366. In the embodiment, the limitation structure 42 and the accommodating slot 27 are structurally integrated. The limitation structure 42 is equivalent to an extension of a side wall of the accommodating slot 27; however, it is not limited thereto in practice. For other descriptions about the limitation structure 42, please refer to the relevant descriptions of the limitation structure 22 and variants thereof in the foregoing, which will not be described in addition. Furthermore, in practice, it is practicable to dispose one or more of the limitation structure 42 and the accommodating slots 26 and 27.

In addition, in the above embodiments, the electrical apparatuses 1 and 3 are electrical apparatuses with rotary components, e.g. but not limited to a genetic testing device. Furthermore, in the electrical apparatuses 1 and 3, the first and second device bodies 12 and 14 are the base and the rotary components of the genetic testing device respectively. In practice, the cable-arrangement structure formed by the first and second device bodies 12 and 14 and the cables 16 and 36 also can be applied to other structures that relatively rotate in the device, which will not be described in addition.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A cable-arrangement structure, comprising:

a first device body;

a second device body, rotatably connected with the first device body relative a rotation axis;

a cable, having a first fixed segment fixed to the first device body, a second fixed segment fixed to the second device body, and a connecting segment connecting the first fixed segment and the second fixed segment and being movably around the rotation axis; and a limitation structure, disposed between the first device body and the second device body and surrounding the connecting segment relative to the rotation axis.

2. The cable-arrangement structure according to claim 1, wherein a reference plane is defined on the cable-arrangement structure and is perpendicular to the rotation axis, and a projection of the connecting segment onto the reference plane shows a spiral.

3. The cable-arrangement structure according to claim 2, further comprising a supporting plate, disposed between the first device body and the second device body, wherein the connecting segment is located between the second device body and the supporting plate, and the first fixed segment is located between the first device body and the supporting plate.

4. The cable-arrangement structure according to claim 1, wherein the connecting segment is wound around the rotation axis by at least one turn.

5. The cable-arrangement structure according to claim 1, wherein the first fixed segment and the second fixed segment are fixed to the first device body and the second device body respectively through a fixing part.

6. The cable-arrangement structure according to claim 1, wherein the connecting segment comprises a first abutting segment abutting against the first device body, a second abutting segment abutting against the second device body, and an intermediate segment connecting the first and second abutting segments, and lengths of the first and second abutting segments vary as the first and second device bodies relatively rotate.

7. The cable-arrangement structure according to claim 6, further comprising an accommodating slot, disposed on the second device body and extending around the rotation axis, wherein the second abutting segment is accommodated in the accommodating slot.

8. The cable-arrangement structure according to claim 1, further comprising a guiding part, slidably connected to the first device body parallel to the rotation axis, wherein the second device body has a peripheral wall surface and a guiding slot formed on the peripheral wall surface, the guiding slot extends around the rotation axis and has two end portions, and the guiding part is slidably disposed in the guiding slot.

9. The cable-arrangement structure according to claim 8, wherein the guiding slot shows a spiral relative to the rotation axis.

10. The cable-arrangement structure according to claim 8, wherein the guiding part has a protruding post extending into the guiding slot, the peripheral wall surface has a circumference relative to the rotation axis, and an extension length of the guiding slot is greater than or equal to a sum of the circumference and a width of the protruding post.

11. The cable-arrangement structure according to claim 1, wherein a rotatable angle range of the second device body relative to the first device body is positively correlated with a length of the connecting segment.

12. The cable-arrangement structure according to claim 11, wherein the rotatable angle range is larger than 360 degrees.

13. An electrical apparatus, comprising:

a first device body, comprising a first controlling module having a first electrical connection portion;

a second device body, comprising a second controlling module having a second electrical connection portion and being rotatably connected with the first device body relative a rotation axis;

a cable, having a first fixed segment fixed to the first device body, a second fixed segment fixed to the second device body, and a connecting segment connecting the first fixed segment and the second fixed segment and being movably around the rotation axis, the first and second fixed segments being electrically connected with the first and second electrical connection portions respectively, the first controlling module powering the second controlling module through the cable, the first and second controlling module communicating with each other through the cable;

a rotation connection structure, disposed along the rotation axis, the second device body being rotatably connected to the first device body through the rotation connection structure, the connecting segment being wound the rotation connection structure, the first controlling module being electrically connected to the rotation connection structure and controlling rotation of the rotation connection structure.

14. The electrical apparatus according to claim 13, wherein the connecting segment is wound around the rotation axis by at least one turn.

15. The electrical apparatus according to claim 13, wherein the connecting segment comprises a first abutting segment abutting against the first device body, a second abutting segment abutting against the second device body, and an intermediate segment connecting the first and second abutting segments, and lengths of the first and second abutting segments vary as the first and second device bodies relatively rotate.

16. The electrical apparatus according to claim 13, wherein a rotatable angle range of the second device body relative to the first device body is positively correlated with a length of the connecting segment.

* * * * *